United States Patent [19]

Tausanovitch et al.

[11] 4,044,987

[45] Aug. 30, 1977

[54] EXTERNALLY CONTROLLED SPREADER SYSTEM

[76] Inventors: Dusan Tausanovitch, 24 Crestwood Drive, Northport, N.Y. 11768; Peter R. Lovisa, 1040 Pelhamdale Ave., Pelham, N.Y. 10803; Tullio E. Lovisa, 91 Whitson Road, Huntington, N.Y. 11743

[21] Appl. No.: 738,549

[22] Filed: Nov. 3, 1976

Related U.S. Application Data

[60] Continuation-in-part of Ser. No. 629,369, Nov. 6, 1975, which is a division of Ser. No. 525,887, Nov. 21, 1974, Pat. No. 3,920,214.

[51] Int. Cl.[2] ..... E04G 17/00; E04G 11/06

[52] U.S. Cl. ..... 249/219 W; 249/42; 249/216

[58] Field of Search ..... 249/40, 42, 45, 46, 249/190, 191, 213, 216, 217, 218, 219 R, 219 W

[56] References Cited

U.S. PATENT DOCUMENTS 2,172,461 9/1939 Whitescarver ..... 249/213 X

*Primary Examiner*—Francis S. Husar
*Assistant Examiner*—John S. Brown
*Attorney, Agent, or Firm*—Kane, Dalsimer, Kane, Sullivan and Kurucz

[57] ABSTRACT

An externally controlled spreader system is designed for the adjustment of forms in both lateral directions and includes a nut having a continuous circular notch on its exterior surface which cooperates with a slotted hole in a slidable plate externally mounted on a washer which is connected to the forms. The nut is adapted to be coupled with the threaded end of a tie rod to apply an axial force, and in this manner the forms are moved laterally in the desired direction while being maintained at a selected predetermined distance apart.

15 Claims, 9 Drawing Figures

EXTERNALLY CONTROLLED SPREADER SYSTEM

REFERENCE TO RELATED APPLICATION

This application is a continuation-in-part of U.S. application Ser. No. 629,369 filed Nov. 6, 1975 which in turn is a division of application Ser. No. 525,887 filed Nov. 21, 1974, now U.S. Pat. No. 3,920,214 granted Nov. 18, 1975.

SUMMARY OF THE INVENTION

The principal object of the present invention is to provide an improved and novel spreader system for concrete form ties having threaded ends, whereby a simple but effective control in adjustment of forms in both directions is feasible thereby minimizing costly and time consuming labor, with the form being capable of adjustment at essentially any desired distance apart over a predetermined range of adjustment for the same tie to accommodate different wall sizes.

According to the invention herein, an externally controlled adjustment is provided for the form distance and is achieved by a releasable connection between an externally slidable plate forming part of a plate-washer assembly and a nut, which during the threading operation exerts force on the plate-washer assembly, the washer of which is securely attached to the forms, and consequently the forms are moved and maintained at the desired distance apart from one another.

Other objects and advantages will become apparent from the following detailed description which is to be taken in conjunction with the accompanying drawings.

DETAILED DESCRIPTION

Figure 1:
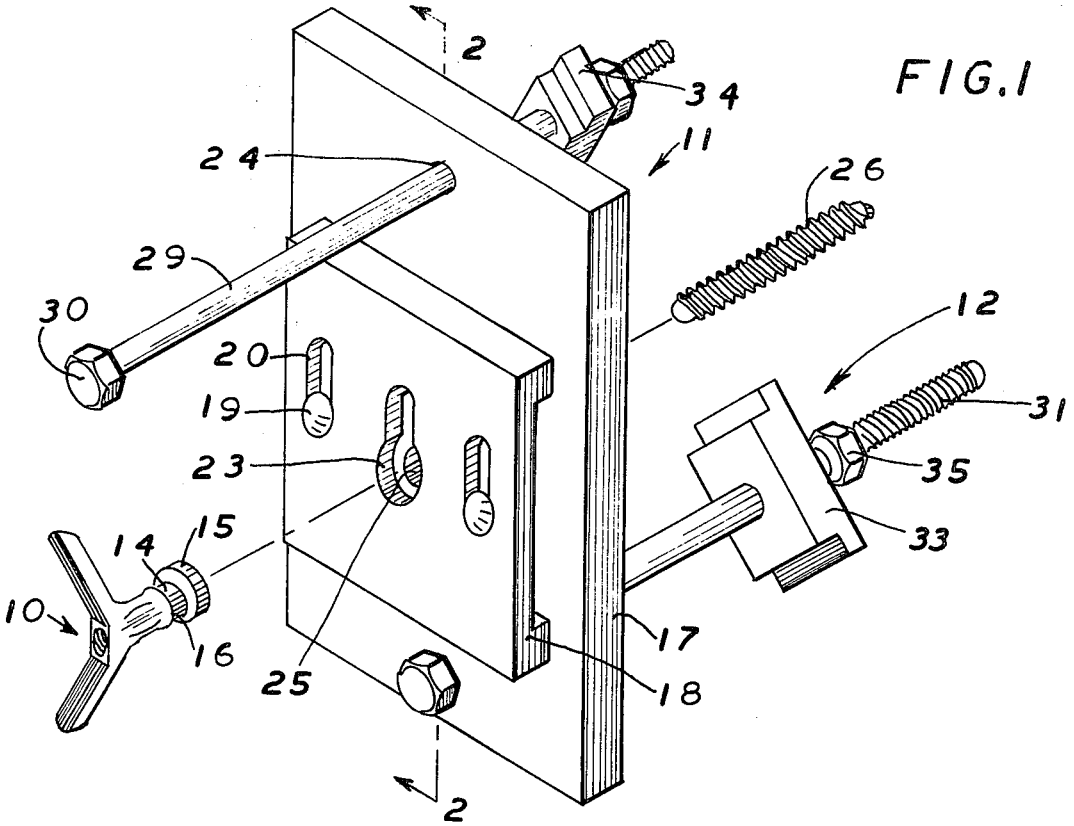
FIG. 1 is an exploded view of the improved concrete form spreader system.

The form spreader system of the present invention shown in FIG. 1 includes a nut 10, a plate-washer 11, and a pair of waler holders 12. Nut 10 is internally threaded and has a continuous circular and circumferentially extending notch 14, radially projected bottom flange 15 and a larger upper portion or head 16.

Figure 2:
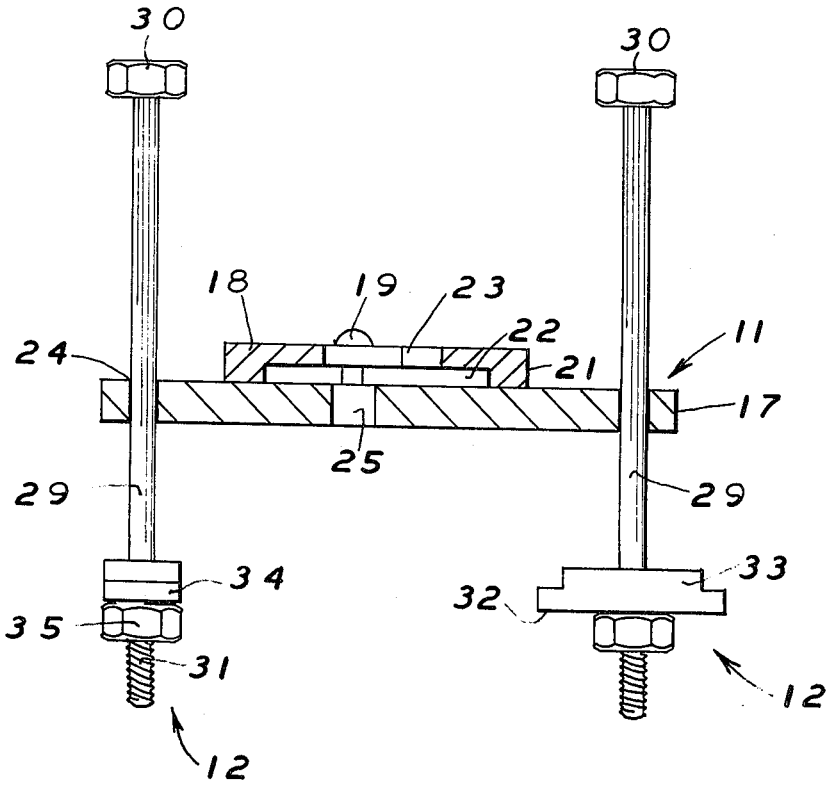
FIG. 2 is a sectional view taken along the line 2—2 of FIG. 1.

Plate-washer assembly 11, also shown separately in FIG. 2, consists of a washer 17 in plate form and a slidable plate 18 coupled to the washer by means of two rivets 19 or similar connectors disposed in two elongated slotted holes 20 located in the plate 18. The plate 18 is provided with a pair of spaced laterally extending flanges 21 which are adapted to engage with the washer 17 and consequently form the recess 22 therewith for accommodating the flange 15 of the nut 10. As shown in FIG. 2, the inner part of the rivets 19 are flush with the inner face of the washer 17 to permit uninterrupted and firm surface-to-surface engagement between the washer 17 and associated surfaces of the neighboring walers. Elongated hole 23 in the sliding plate 18 is modified in shape to engage or disengage surfaces defining notch 14 of nut 10 (see FIG. 6) depending on the relative position of the plate 17. The width of the continuous notch 14 is slightly larger than the thickness of the slidable plate 17 in order to reduce any friction between this plate and the nut 10 during the releasing operation after the concrete has been poured. The washer 17 is provided with a pair of holes 24 which receive the waler holders 12. In addition, washer 17 is provided with a centrally disposed hole 25 having a diameter sufficiently large to receive the threaded end of tie rod 26 but at the same time less than the diameter of the flange 15 of the nut 10 to assure its accommodation within the recess 22.

Figure 3:
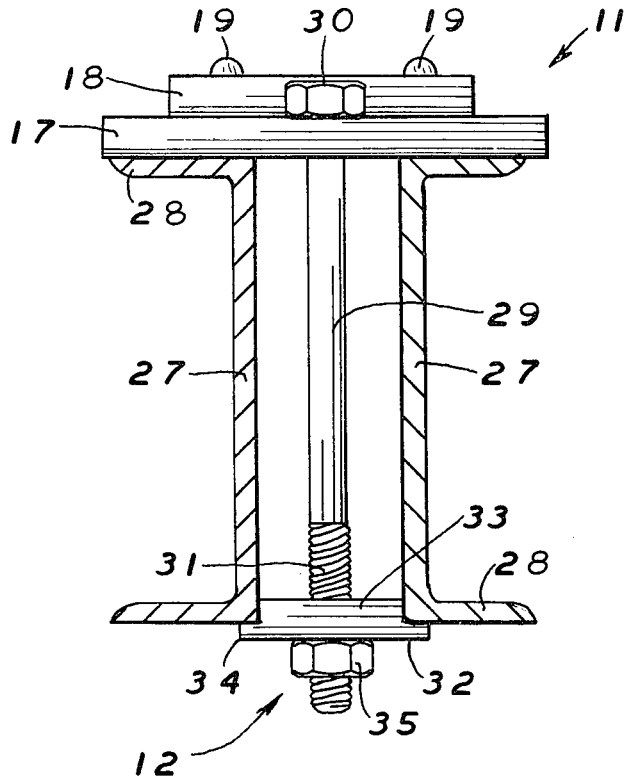
FIG. 3 is a sectional view showing the plate-washer assembly associated with steel walers.

The spreader system of FIGS. 1-6 is primarily designed for heavier ties, which require steel or metal walers 27 each having laterally extending flanges 28. The illustrated waler holders 12 are conventional and include a bolt 29 having an enlarged head 30 and a threaded stem 31. The washer 32 includes a base portion 33 adapted to be disposed between adjacent walers 27 and an enlarged head 34 adapted to bear against the lateral flanges 28 of the respective walers 27. The internally threaded nut 35 when tightened as a result of turning of the head 30 will secure the plate-washer assembly 11 to the associated walers 27 as shown in FIG. 3. Where wooden walers are employed, the holes 24 may be located at the corners of the washer 17 to receive nails for securing the washer 17 to the wooden waler thereby anchoring the plate-washer assembly 11 to the forms.

Figure 4:
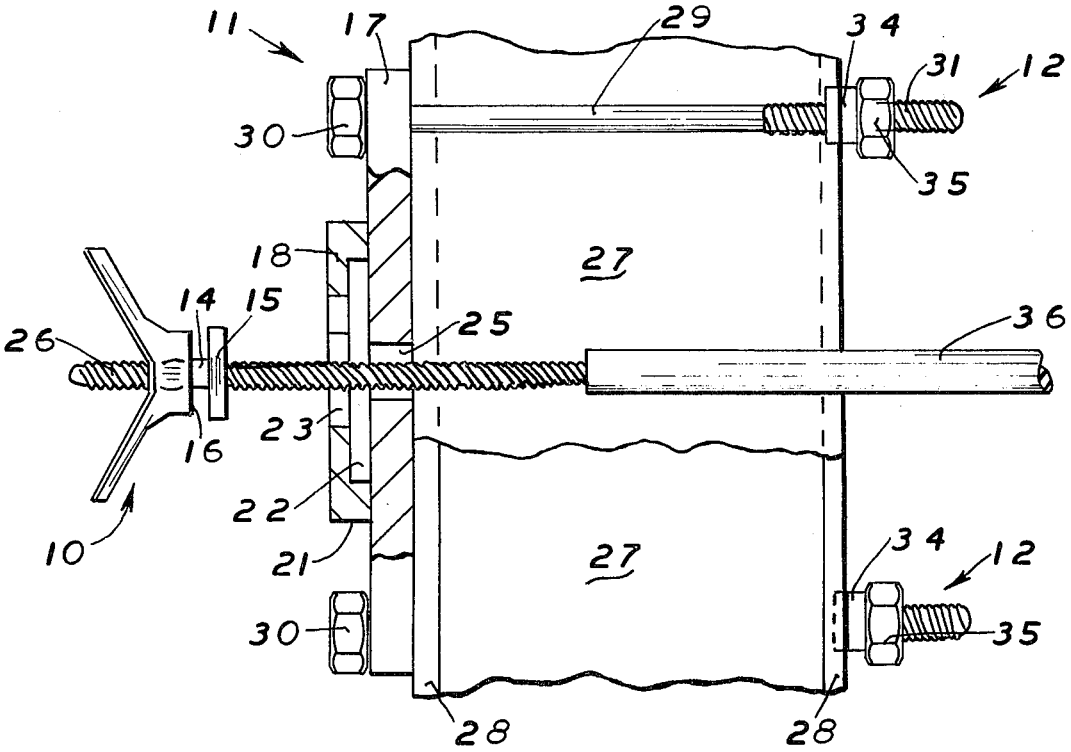
FIG. 4 is an elevational view partly in section showing the plate-washer assembly, nut and tie rod prior to assembly.
Figure 5:
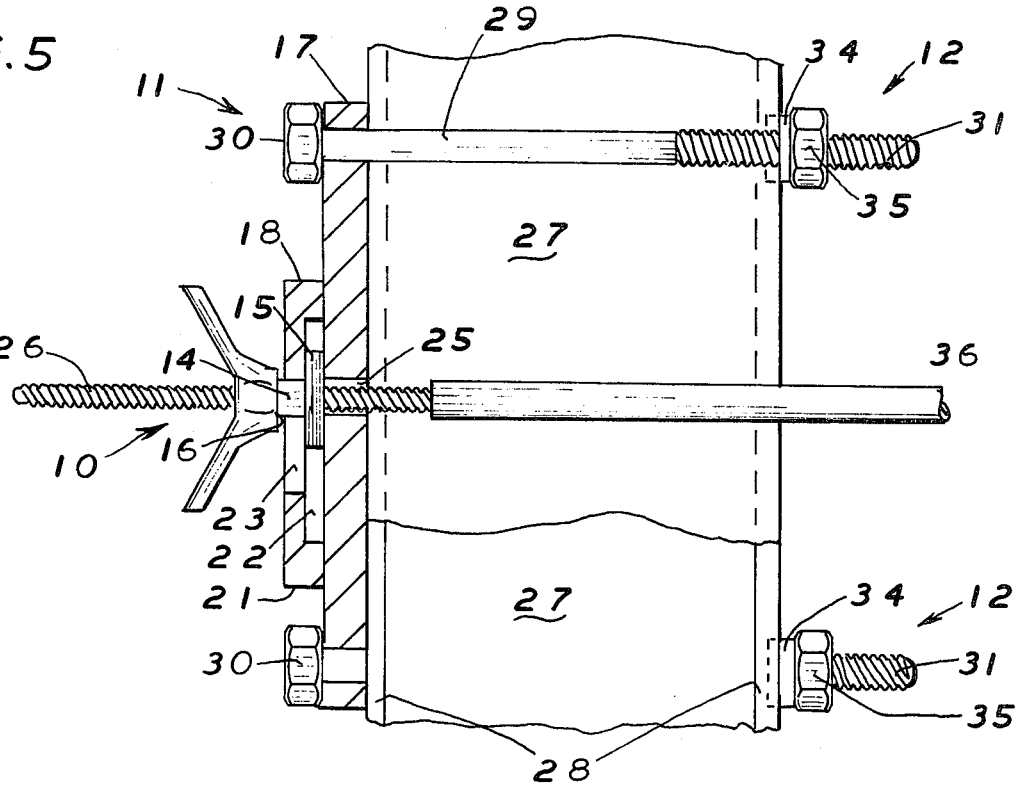
FIG. 5 is a similar view showing the nut coupled with the plate-washer assembly showing the engagement of the sliding plate and nut.
Figure 6:
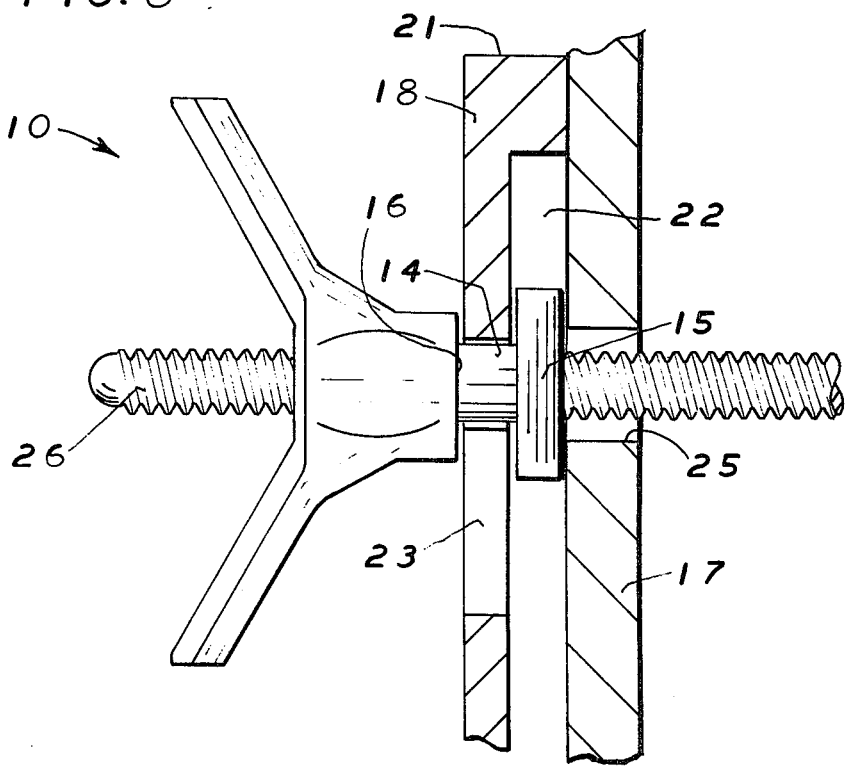
FIG. 6 is an enlarged sectional view showing the slidable plate shifted into engagement with the nut.

In FIG. 4 the spreader system of this invention is applied to one type of commercial removable tie rod 26 which may have associated therewith an elastic sleeve 36. In this figure, the slidable plate 18 is in its raised or elevated disengaged position at which the tie 26 is free to be completely removed from or on the other hand inserted into the holes 25 and 23 of the washer 17 and slidable plate 18, respectively. Threading of the nut 10 on the externally threaded tie 26 will eventually have the flange 15 move through the hole 23 of the raised plate 18 into recess 22 and interengagement with the washer 17 (see FIG. 5). The plate may then be lowered and in actual practice drops by gravity to form a gravity lock. Thus, with the disposition of parts as shown in FIGS. 5 and 6, nut 10 will exert force on the plate-washer assembly 11. Consequently, the forms may move out or in, depending on the direction of turning or threading of the nut 10 thereby maintaining the forms in any desired position by means of the cooperative interconnection between the spreader system and the tie 26 to withstand compressive or tensile forces applied to the forms. In this connection, and with repsect to the spreader system, the nut 10 will take the concrete load. When the nut 10 is turned clockwise, the nut will exert a force on the washer 17, whereas, plate 18 only takes a load when the nut 10 is turned counterclockwise. It will be evident that adjustment and spreading of the forms is achieved in a simple and effective way without any loose parts forming part of the spreader system. The spreader system of this invention offers a continuous range of adjustment for the same tie used in different wall sizes. Positive control of such adjustment is provided by simply measuring the lengths of the threaded tie rod ends that are projected beyond the nuts 10. As a simplification of the adjustments, the tie may be equipped with only one threaded end, with swedging at the other end (not shown) which would automatically stop and locate the nut 10 in a fixed position, leaving only one opposite long threaded tie end for required adjustment and measurement of tie end length projected beyond nut 10. This simplified arrangement advantageously contemplates the longer threaded tie end being installed only on the closing form which under these circumstances is conveniently adjustable.

Figure 7:
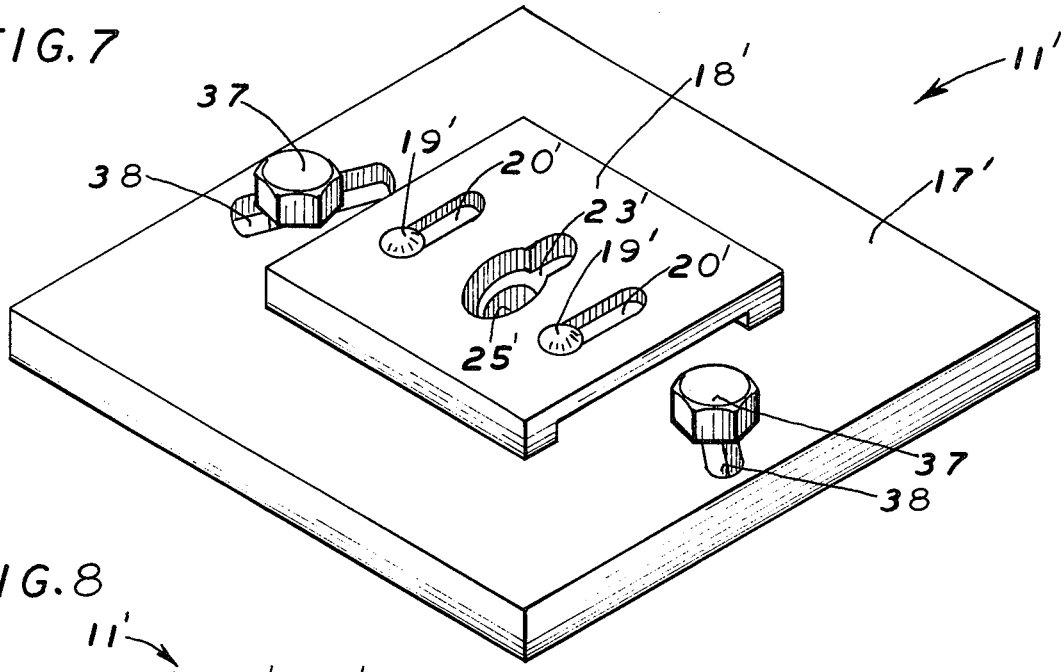
FIG. 7 is a perspective view of the spreader system with a different form of waler holders.
Figure 8:
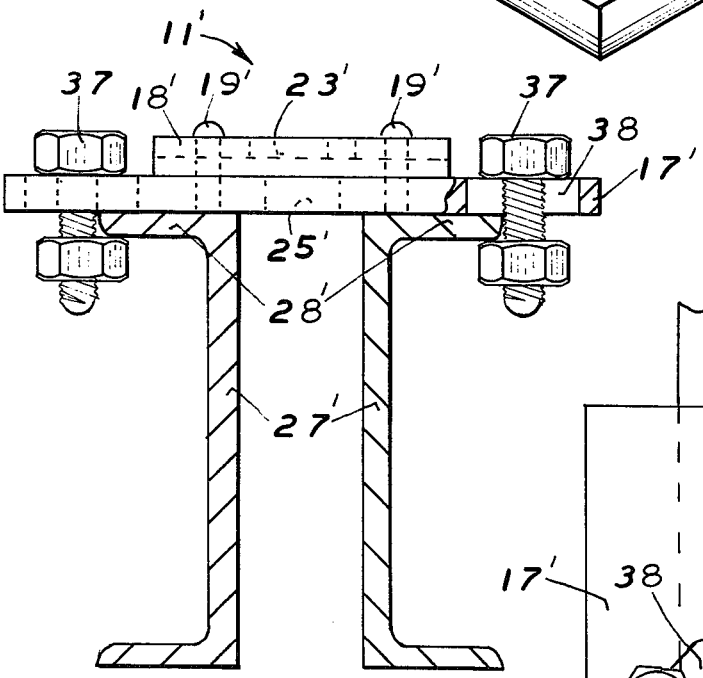
FIG. 8 is an end view of the spreader system of FIG. 7 with certain parts broken away and removed showing the matter of attachment to the walers.
Figure 9:
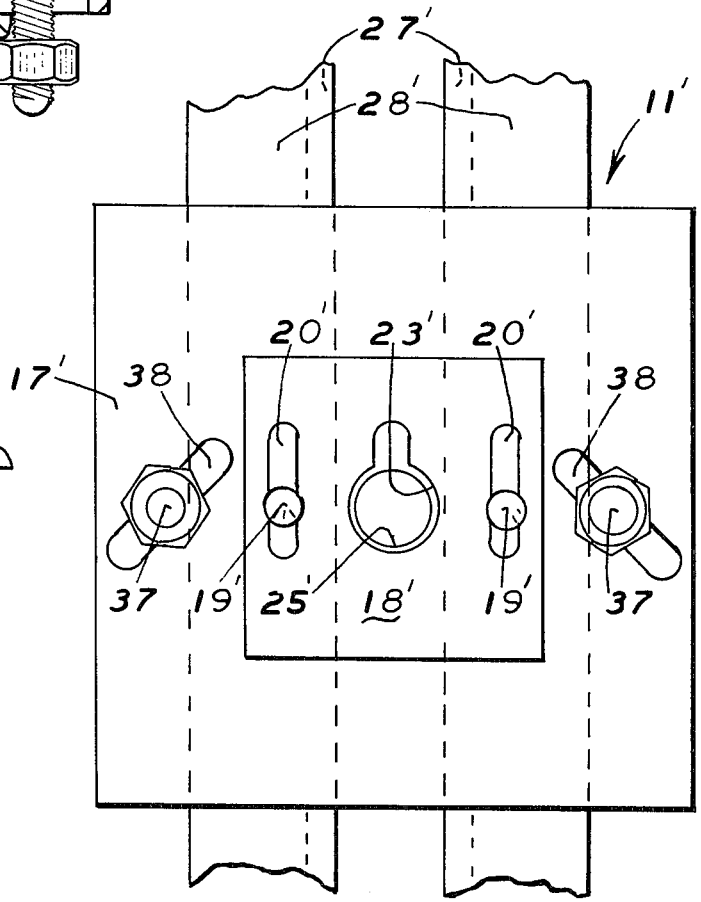
FIG. 9 is a front elevational view thereof.

In FIGS. 7 and 8 the plate-washer assembly 11' is connected to the walers 27' by self-attachable slidable double headed rivets or as shown, bolts 37 having a nut at one end, which are slidable in the slotted holes 38 appearing at the sides of the washer 17'. When the rivets are disposed at the lower extremity of the inwardly canted slotted holes 38, the inner nut on the bolt is capable of clearing the outer edge of the laterally extending flanges 28'. When the washer 17' is permitted to shift downwardly by gravity, the camming action of the bolts 37 against the surfaces of the slotted holes 38 will force the bolts inwardly into engagement with the edges of the waler flanges 28' to lock the plate-washer assembly 11' in place on the associated walers 27 by friction. When it is desired to remove the plate-washer assembly 11' from the walers 27, a simple hammer-blow at the bottom of the washer 17' will free the slidable bolts 37 and permit the washer 17' to be elevated to remove the plate-washer assembly 11' from the walers 27'.

From the foregoing description, it will be seen that the present invention provides an improved, simple and economical exterior spreader system with easily achieved adjustment of forms in both directions and with elmination of all loose parts common to conventional spreader systems.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. An exterior spreader system for a threaded end tie rod to provide for controlled adjustment of concrete forms in both directions lengthwise of the tie rod, comprising:

a. nut means internally threaded for engagement with the adjacent end of the tie rod, said nut means having an inner end and other end and having a groove in the side thereof defined partly by a flange at the inner end;

b. a plate washer assembly incuding a washer adapted to be secured to a form and including a slidable plate slidably coupled to the exterior of the washer and defining therewith a recess, the plate having a through hole receiving the flange therethrough for disposition within the recess, the plate being shiftable from a first disengaged position at which the flange is adapted to be inserted through the through hole into the recess and a second locked position at which the flange is locked within the recess and consequently the nut means is locked relative to the plate-washer assembly by the disposition of surfaces of the plate within said groove establishing a driving relation between said nut means and said plate-washer assembly; and c. whereby threaded movement of said nut means on the tie rod will be transmitted through said flange and said plate-washer assembly to the form to which said washer is secured.

2. The invention in accordance with claim 1, wherein the washer is in plate form and is provided with means for coupling with walers.

3. The invention in accordance with claim 2, wherein the walers are metal and of channel cross-section having laterally extending flanges and the means for cooperating in securing the washer to a waler includes at least one waler holder.

4. The invention in accordance with claim 3, wherein the waler holder is in the form of a threaded bolt having a head adapted to engage with the exterior of the washer and a freely movable washer on the bolt in engagement with the inner most flange of the associated walers and a nut on the threaded end of the bolt in engagement with the movable washer for securing the waler holder and consequently the plate washer assembly to the associated walers.

5. The invention in accordance with claim 3, wherein the waler holder includes a pair of rod shaped members having an enlarged head at each end slidably disposed in a angularly disposed slotted hole in the washer, the slotted holes being canted upwardly and inwardly towards one another whereby when the waler is raised and the double-headed rod shaped members are at the lower part of the accommodating slotted hole the inner head of each member is adapted to clear the outer edge of the associated waler flange and when the washer is permitted to be lowered by gravity of members are adapted to cam against the canted surfaces of the canted slotted holes to force the members into frictional engagement with the edge of the associated waler flange with the inner head in engagement with surfaces of the associated waler flange to thereby secure the plate-washer assembly to the associated walers and when the plate-washer assembly is to be removed from the associated walers the washer of the plate-washer assembly is struck by a hammer from below to raise such washer to free the rod shaped members from frictional engagement with the waler flanges to permit the washer to be elevated to clear the rod shaped members from the waler flanges and permit the plate-washer assembly to be removed from the associated walers.

6. The invention in accordance with claim 2, wherein the washer includes a centrally disposed hole for reception of the threaded end of the tie rod.

7. The invention in accordance with claim 1, wherein the slidable plate includes a pair of inwardly extending spaced flanges having a length corresponding to the depth of the recess engaging with exterior surfaces of the washer to define therewith said recess for reception of the flange of the nut means.

8. The invention in accordance with claim 7, wherein the slidable plate includes a pair of elongated slotted openings which receive the shank of a double-headed member the movement of which within said slot defines the extent of sliding movement of the plate relative to the washer.

9. The invention in accordance with claim 1, wherein the through hole includes a lower enlarged part of a diameter sufficient to receive therethrough the flange of the nut means therethrough and an upper reduced size part which is adapted to be disposed about the groove of said nut means to drivably secure the nut means to the plate-washer assembly.

10. A plate-washer assembly for securement to forms for concrete and for releasably coupling with cooperating parts of an exterior spreader system which includes a nut means cooperating with a threaded end tie rod, the nut means including an inner end and an outer end having a groove in the side thereof defined partly by a flange at the inner end, the spreader system permitting adjustment of the concrete forms in both lateral directions and for a selected series of predetermined different wall thicknesses, the assembly includes a washer and a plate shiftably connected with the washer, the washer adapted to be coupled to the walers of the forms, the slidable plate slidably coupled to the exterior of the washer and defining therewith a recess, the plate having a through hole sized to receive the flange therethrough for disposition within the recess, the plate being shiftable from a first disengaged position at which the flange is adapted to be inserted through the hole into the recess and a second locked position at which the flange is locked within the recess and consequently the nut means is locked relative to the plate-washer assembly by the disposition of surfaces of the plate within said groove establishing a driving relation between said nut means and said plate-washer assembly, whereby threaded movement of said nut means on the tie rod will be transmitted through said flange and said plate-washer assembly to the form to which said washer is secured.

11. The invention in accordance with claim 10, wherein the washer is in plate form and is provided with means for coupling with walers.

12. The invention in accordance with claim 10, wherein the washer includes a centrally disposed hole for reception of the threaded end of the tie rod.

13. The invention in accordance with claim 10, wherein the slidable plate includes a pair of inwardly extending spaced flanges having a length corresponding to the depth of the recess engaging with exterior surfaces of the washer to define therewith said recess for reception of the flange of the nut means.

14. The invention in accordance with claim 10, wherein the slideable plate includes a pair of elongated slotted openings which receive the shank of a double-headed member the movement of which within said slot defines the extent of sliding movement of the plate relative to the washer.

15. The invention in accordance with claim 10, wherein the through hole includes a lower enlarged part of a diameter sufficient to receive therethrough the flange of the nut means therethrough and an upper reduced size part which is adapted to be disposed about the groove of said nut means to drivably secure the nut means to the plate-washer assembly.

* * * * *